US010088797B2

(12) United States Patent
Nguyen

(10) Patent No.: US 10,088,797 B2
(45) Date of Patent: Oct. 2, 2018

(54) IMAGE FORMING APPARATUS

(71) Applicant: KYOCERA Document Solutions Inc., Osaka (JP)

(72) Inventor: Chien Danh Nguyen, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 15/846,316

(22) Filed: Dec. 19, 2017

(65) Prior Publication Data

US 2018/0181053 A1 Jun. 28, 2018

(30) Foreign Application Priority Data

Dec. 26, 2016 (JP) ..... 2016-250347

(51) Int. Cl.
*G03G 15/00* (2006.01)
*G03G 21/16* (2006.01)

(52) U.S. Cl.
CPC ..... *G03G 21/1633* (2013.01)

(58) Field of Classification Search
CPC ..... G03G 21/1633; G03G 21/1647
See application file for complete search history.

(56) References Cited

U.S. PATENT DOCUMENTS 6,647,223 B2 * 11/2003 Ishii ..... G03G 15/80 399/124
6,678,481 B2 * 1/2004 Sawanaka ..... G03G 21/1633 399/13
7,349,648 B2 * 3/2008 Rennick ..... G03G 21/1638 399/110
7,386,252 B2 * 6/2008 Portig ..... B41J 29/02 399/110
8,204,401 B2 * 6/2012 Tsuchiya ..... G03G 21/1633 399/107
2008/0219697 A1 * 9/2008 Itabashi ..... G03G 21/1817 399/114
2010/0329728 A1 * 12/2010 Irie ..... G03G 21/1628 399/110
2011/0182614 A1 * 7/2011 Onuma ..... G03G 21/1633 399/110
2012/0012445 A1 * 1/2012 Ohta ..... G03G 21/1633 200/50.12
2014/0140724 A1 * 5/2014 Yuzawa ..... G03G 21/1633 399/110

(Continued)

FOREIGN PATENT DOCUMENTS

JP 2001152724 A * 6/2001
JP 2001152726 A * 6/2001
JP 2004-359441 12/2004

*Primary Examiner* — David Bolduc
(74) *Attorney, Agent, or Firm* — Gerald E. Hespos; Michael J. Porco; Matthew T. Hespos

(57) ABSTRACT

An image forming apparatus includes a body housing with an inner space, and an image forming unit. The body housing includes a front cover, a top cover, and an interlocking mechanism. The interlocking mechanism lifts a front end of the top cover by a predetermined distance in association with an operation of opening the front cover from a state that the top cover and the front cover are closed. The interlocking mechanism holds a closed state of the top cover for a period until the front cover is closed from a state that the top cover is closed and the front cover is opened.

5 Claims, 20 Drawing Sheets

(56) References Cited

U.S. PATENT DOCUMENTS

| | | | | |
|---|---|---|---|---|
| 2015/0050042 | A1* | 2/2015 | Sato | G03G 21/1842 399/110 |
| 2016/0291533 | A1* | 10/2016 | Maeda | G03G 21/1633 |
| 2017/0308028 | A1* | 10/2017 | Domhoff | G03G 21/1633 |

* cited by examiner

IMAGE FORMING APPARATUS

This application is based on Japanese Patent Application No. 2016-250347 filed on Dec. 26, 2016, the contents of which are hereby incorporated by reference.

BACKGROUND

Conventionally, there is known an image forming apparatus provided with an openable cover. In particular, there is known an image forming apparatus including a front cover disposed on a front surface portion of an apparatus body, and a top cover disposed on an upper surface portion of the apparatus body. In the image forming apparatus, the top cover is pivotally moved upwardly around a shaft portion disposed on a rear end of the top cover. Further, the front cover is pivotally moved forwardly around a shaft portion disposed on a lower end of the front cover. Pivotally moving the top cover and the front cover allows an inner space of the apparatus body to be opened to the outside. This makes it possible to mount a unit in the inner space.

SUMMARY

An image forming apparatus according to an aspect of the present disclosure includes a body housing having an inner space; and an image forming unit disposed inside the inner space and configured to form an image on a sheet. The body housing includes a front cover, a top cover, and an interlocking mechanism. The front cover defines a front surface portion of the body housing. The front cover is configured to expose a part of the inner space to an outside of the body housing by being opened forwardly around a first pivot portion disposed on a lower end of the front cover. The top cover defines an upper surface portion of the body housing, and is connected to an upper end of the front cover. The top cover is configured to expose a part of the inner space to the outside of the body housing by being opened upwardly around a second pivot portion disposed on a rear end of the top cover. The interlocking mechanism lifts a front end of the top cover by a predetermined distance in association with an operation of opening the front cover from a state that the top cover and the front cover are closed. The interlocking mechanism holds a closed state of the top cover for a period until the front cover is closed from a state that the top cover is closed and the front cover is opened.

These and other objects, features and advantages of the present disclosure will become more apparent upon reading the following detailed description along with the accompanying drawings.

DETAILED DESCRIPTION

Figure 1:
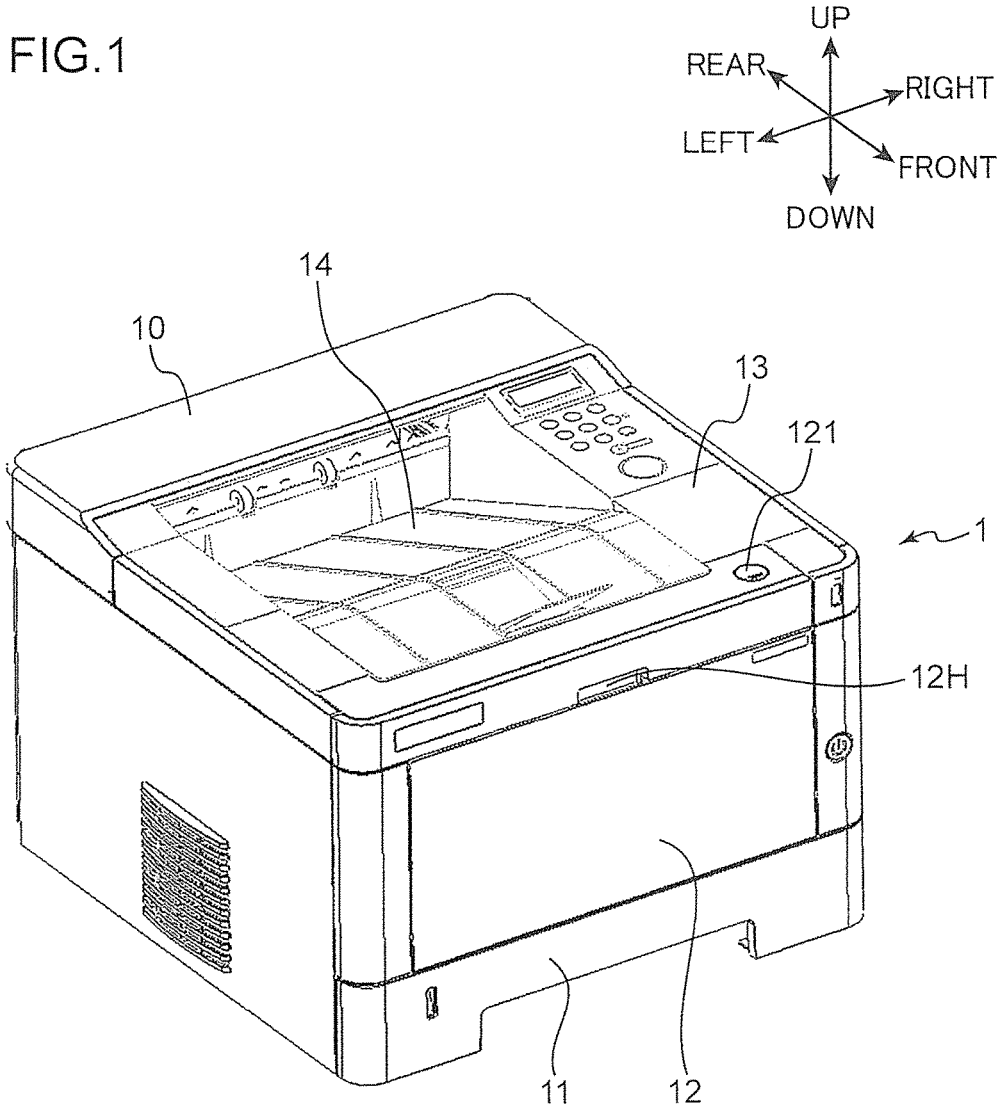
FIG. 1 is a perspective view illustrating an external appearance of an image forming apparatus according to an embodiment of the present disclosure.
Figure 2:
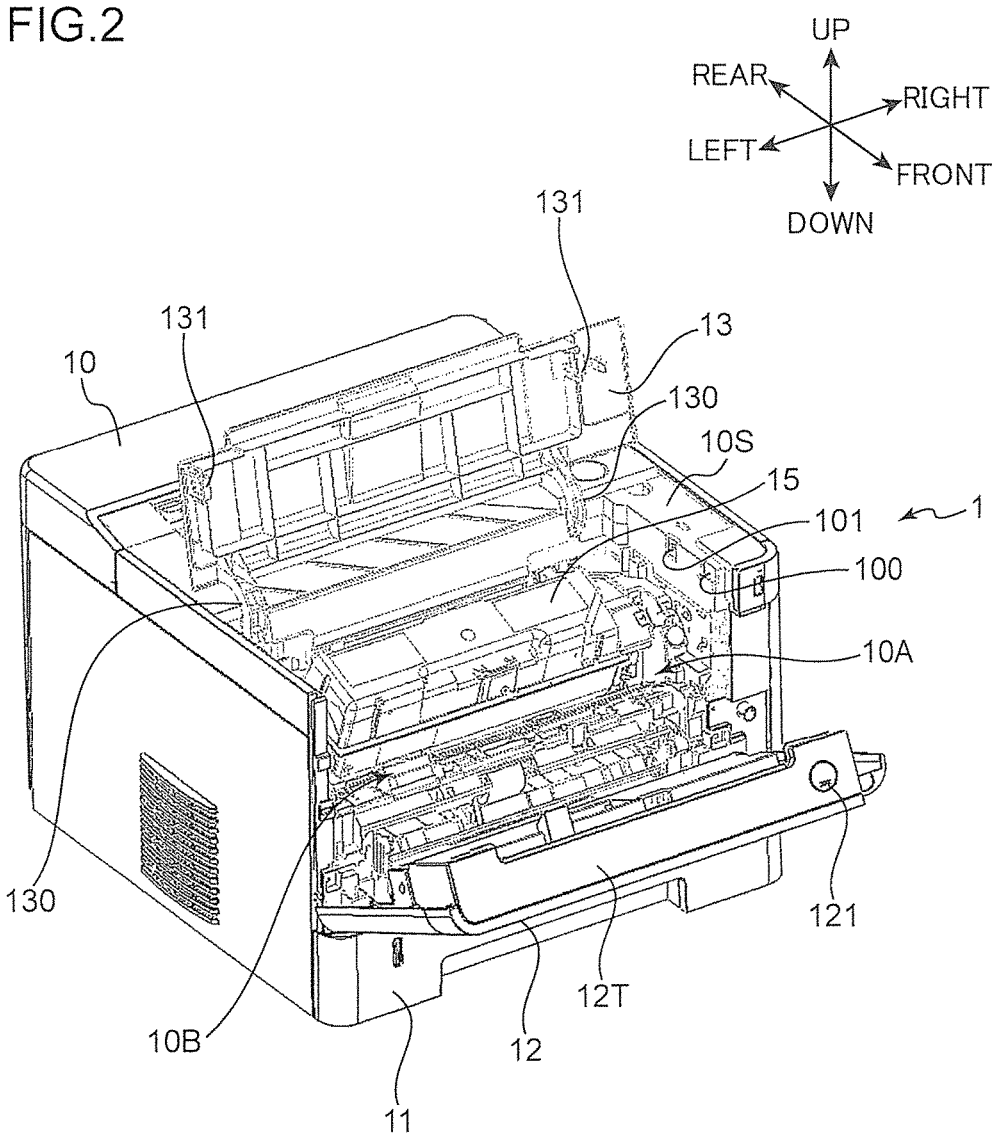
FIG. 2 is a perspective view illustrating a state that a front cover and a top cover of the image forming apparatus illustrated in FIG. 1 are opened.
Figure 3:
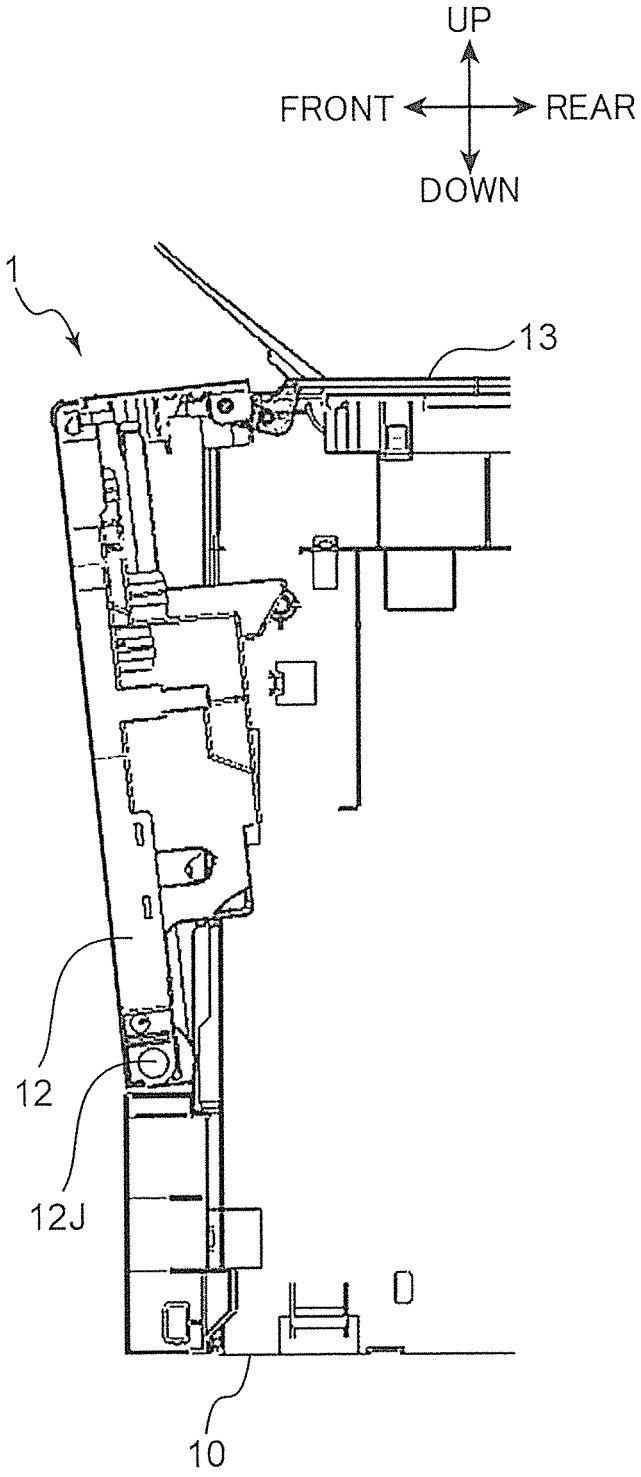
FIG. 3 is a perspective view of a front end of the image forming apparatus illustrated in FIG. 1.
Figure 4:
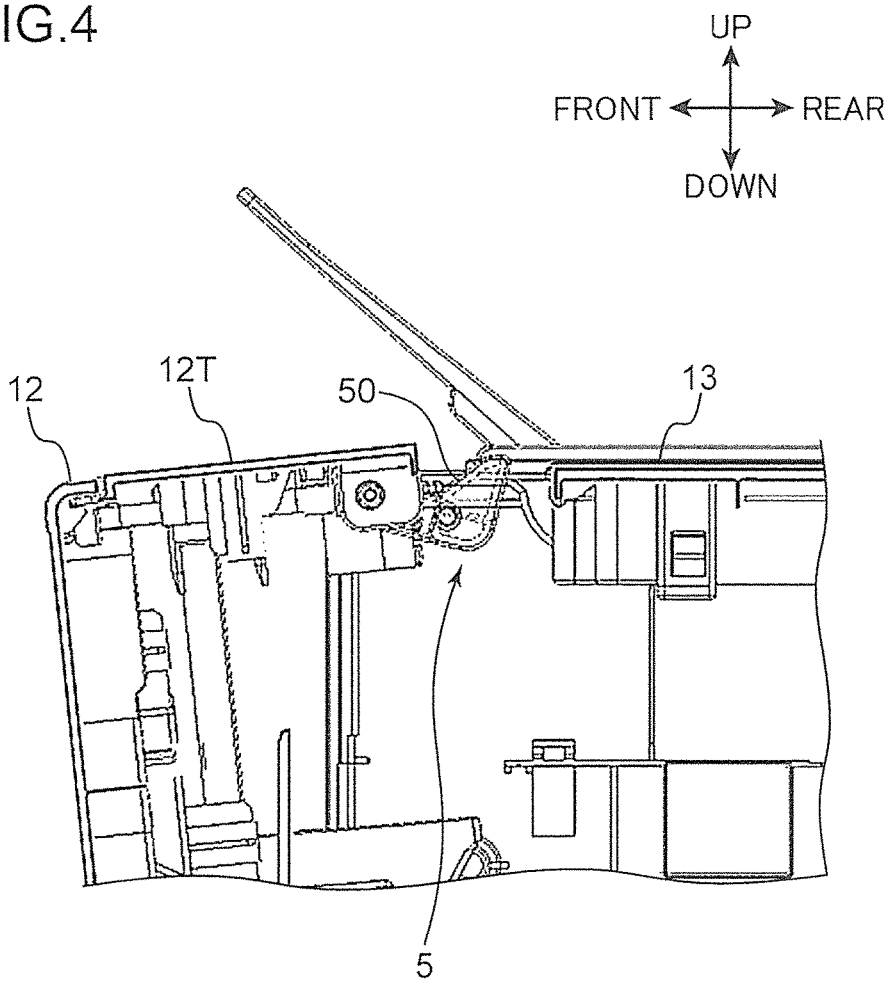
FIG. 4 is an enlarged sectional view partially enlarging the image forming apparatus illustrated in FIG. 3.
Figure 5:
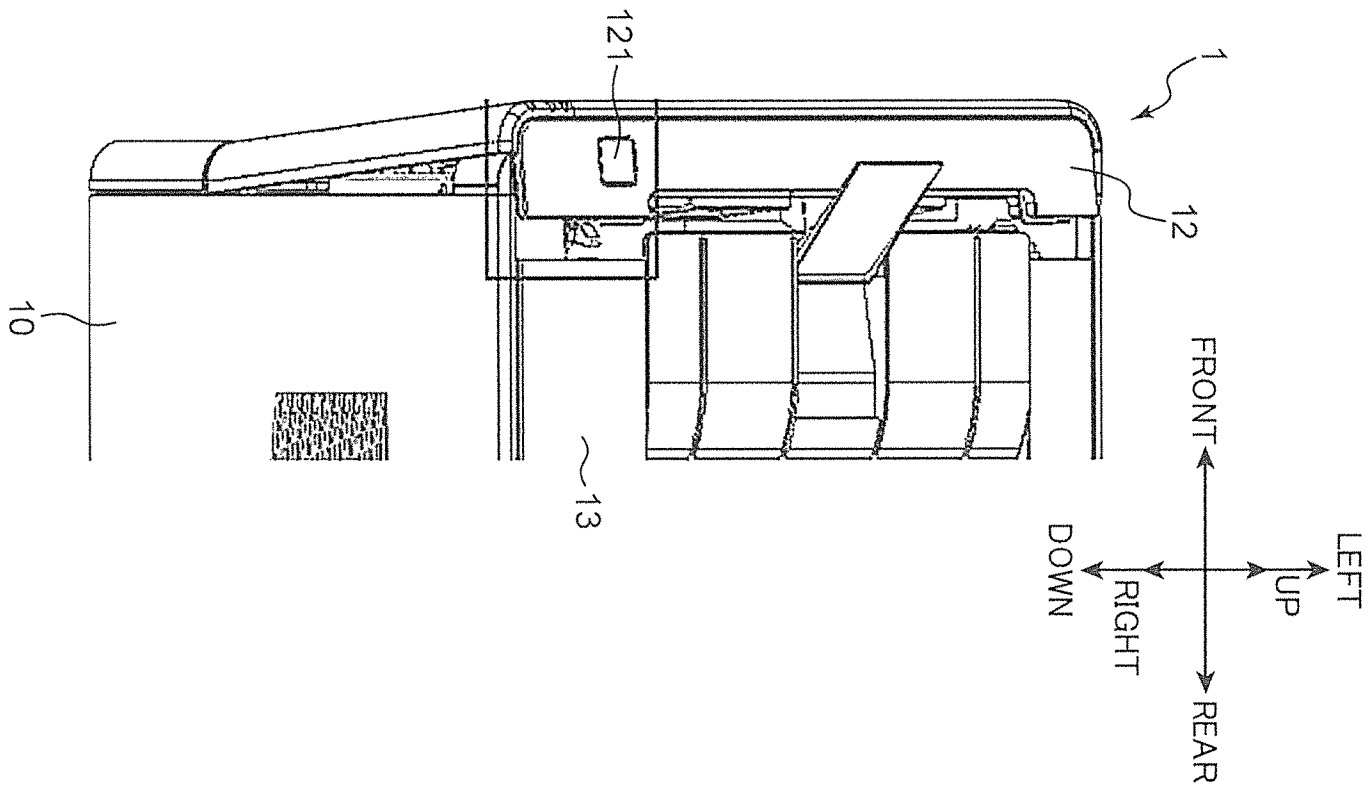
FIG. 5 is a perspective view of the front end of the image forming apparatus illustrated in FIG. 1.
Figure 6:
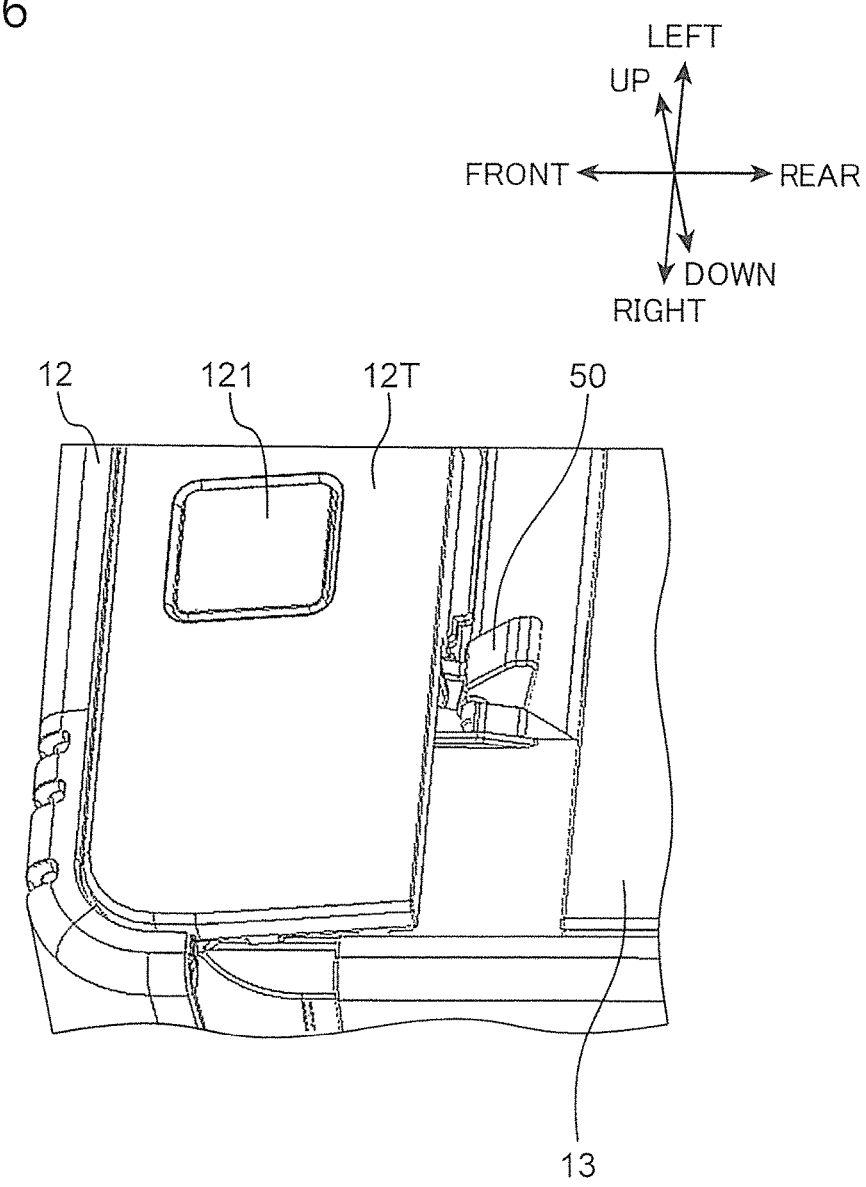
FIG. 6 is an enlarged perspective view partially enlarging the image forming apparatus illustrated in FIG. 5.

In the following, an embodiment of the present disclosure is described in detail referring to the drawings. FIG. 1 is a perspective view illustrating an external appearance of an image forming apparatus 1 according to the embodiment of the present disclosure. FIG. 2 is a perspective view illustrating a state that a front cover 12 and a lid top cover 13 of the image forming apparatus 1 illustrated in FIG. 1 are opened. FIG. 3 is a sectional view of a front end of the image forming apparatus 1 illustrated in FIG. 1. FIG. 4 is an enlarged sectional view partially enlarging the image forming apparatus 1 illustrated in FIG. 3. FIG. 5 is a perspective view of the front end of the image forming apparatus 1 illustrated in FIG. 1. FIG. 6 is an enlarged perspective view partially enlarging the image forming apparatus 1 illustrated in FIG. 5. In the embodiment, the image forming apparatus 1 is a so-called monochromatic printer. The image forming apparatus according to the present disclosure, however, may be a monochromatic copying machine, a color copying machine, a color printer, a facsimile device, or a complex machine having functions of these devices.

The image forming apparatus 1 includes a body housing 10 of a substantially rectangular parallelepiped shape. An inner space 10A (see FIG. 2) is formed inside the body housing 10. An image forming unit 10B (see FIG. 2) is disposed inside the inner space 10A. In the embodiment, the image forming unit 10B forms an image on a sheet based on a well-known electrophotography technique. FIG. 2 illustrates a toner container 15 constituting the image forming unit 10B. The toner container 15 is dismountably mounted in the inner space 10A by a user. Further, the image forming unit 10B includes a photosensitive drum, a developing device, a charging device, an exposure device, and a transfer device, all of which are well-known.

An image forming method by the image forming unit 10B may be another method such as an ink jet method. Further, the body housing 10 includes a sheet cassette 11 (see FIG. 1). Sheets for image formation are accommodated in the sheet cassette 11. Further, a sheet discharge portion 14 is formed on an upper surface portion of the body housing 10. Sheets after image formation are discharged onto the sheet discharge portion 14.

The body housing 10 further includes the front cover 12 (a front cover) and the lid top cover 13 (a top cover).

The front cover 12 is a cover for defining a front surface portion of the body housing 10. The front cover 12 includes a pivot portion 12J (a first pivot portion) (see FIG. 3). The pivot portion 12J is a pivot portion formed on a lower end of the front cover 12, and is pivotally supported on the body housing 10. The front cover 12 exposes a part of the inner space 10A to the outside of the body housing 10 by being opened forwardly around the pivot portion 12J (see FIG. 2).

The front cover 12 further includes a front-cover top plate 12T (see FIG. 2 and FIG. 4). The front-cover top plate 12T is an upper surface portion of the front cover 12, and is disposed in flush with the lid top cover 13.

Figure 7:
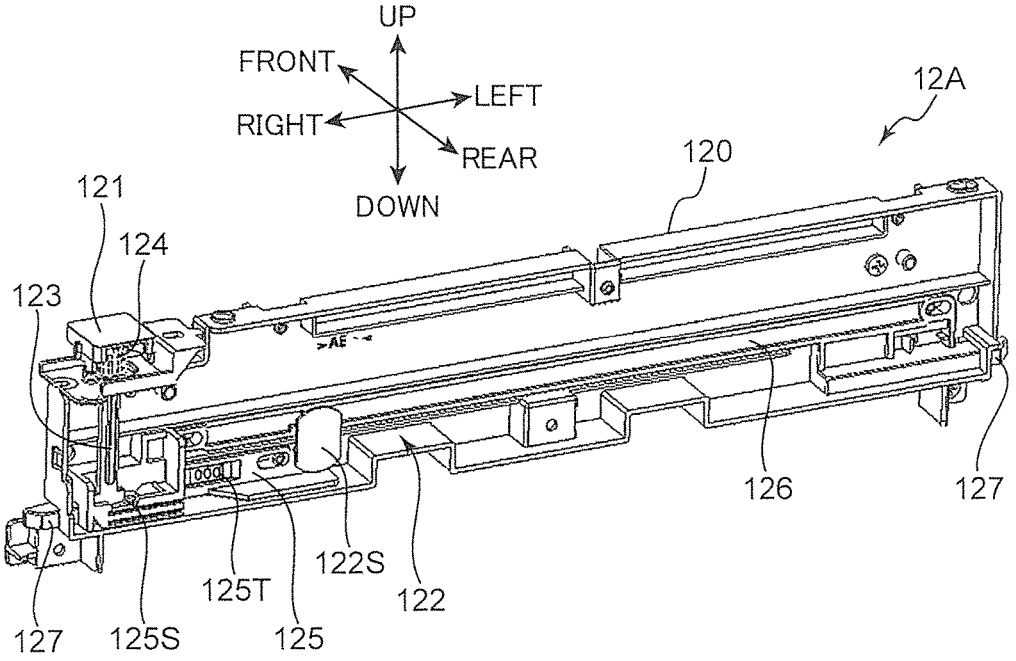
FIG. 7 is a perspective view of an inner unit disposed inside the front cover of the image forming apparatus according to the embodiment of the present disclosure.

The front cover 12 further includes an inner unit 12A. FIG. 7 is a perspective view of the inner unit 12A disposed inside the front cover 12 in the embodiment. The inner unit 12A is disposed to extend in a left-right direction inside the front cover 12. The inner unit 12A includes a cover wall portion 120, a lock release button 121, an interlocking unit 122 (an unlocking mechanism), and a pair of locking members 127. The cover wall portion 120 is a body portion of the inner unit 120A, and is a plate-shaped member extending in a left-right direction and in an up-down direction. The cover wall portion 120 has a predetermined thickness along a front-rear direction.

The lock release button 121 is a button to be pressed by a user when the front cover 12 is opened. In FIG. 7, the lock release button 121 has a rectangular shape. The lock release button 121, however, may have any other shape such as a circular shape, as illustrated in FIG. 1.

The locking members 127 are disposed on both ends of the cover wall portion 120 in a left-right direction. The locking members 127 are projectable and retractable along a left-right direction. Each of the locking members 127 is engageable in a corresponding one of front-cover locking engaging portions 100 (a locking engaging portion) (see FIG. 2) of a housing side unit 10S to be described later.

The interlocking unit 122 unlocks the locking members 127 from the front-cover locking engaging portions 100 in response to a user's operation of pressing the lock release button 121. The interlocking unit 122 includes a vertical piece 123, a coil spring 124, a first interlocking member 125, a second interlocking member 126, a locking-piece pressing spring 125T (an urging member), and a link member 122S.

The vertical piece 123 is a columnar-shaped member extending downwardly from a lower end of the lock release button 121. The coil spring 124 is a spring mounted on the vertical piece 123 between the cover wall portion 120 and the lock release button 121. The coil spring 124 urges the lock release button 121 upwardly. The first interlocking member 125 is a member extending in a left-right direction along a lower end of the cover wall portion 120. One of the locking members 127 is fixed to a distal end (a right end) of the first interlocking member 125. The first interlocking member 125 is urged rightwardly by the locking-piece pressing spring 125T. One end of the locking-piece pressing spring 125T comes into contact with the first interlocking member 125, and the other end of the locking-piece pressing spring 125T comes into contact with the cover wall portion 120. Further, the second interlocking member 126 is a member extending in a left-right direction along the first interlocking member 125 on a lower end of the cover wall portion 120. The first interlocking member 125 and the second interlocking member 126 are connected to each other by the link member 122S. The link member 122S includes a pair of projections respectively received in unillustrated hole portions formed in the first interlocking member 125 and in the second interlocking member 126. An unillustrated pivot is disposed between the paired projections. The pivot is pivotally supported on the cover wall portion 120. Further, the other of the locking members 127 is fixed to a distal end (a left end) of the second interlocking member 126. The front cover 12 is locked to the body housing 10 by engagement of the locking members 127 formed on the first interlocking member 125 and the second interlocking member 126 in the front-cover locking engaging portions 100 of the body housing 10. The locking-piece pressing spring 125T urges the first interlocking member 125 and the second interlocking member 126 in such a manner that the locking members 127 are engaged in the front-cover locking engaging portions 100.

When the lock release button 121 is pressed by a user, the vertical piece 123 is pressed downwardly against an urging force of the coil spring 124. Consequently, a lower end of the vertical piece 123 comes into contact with a slope portion 125S formed on the first interlocking member 125, and the first interlocking member 125 is slidably moved leftwardly. Consequently, the right-side locking member 127 illustrated in FIG. 7 is retracted from the right-side front-cover locking engaging portion 100 of the body housing 10. Further, when the first interlocking member 125 is slidably moved leftwardly, the link member 122S is pivotally moved around the pivot, and the second interlocking member 126 is slidably moved rightwardly. Consequently, the left-side locking member 127 illustrated in FIG. 7 is retracted from the left-side front-cover locking engaging portion 100 of the body housing 10. As described above, a locked state of the front cover 12 with respect to the body housing 10 is released by a pressing operation of the lock release button 121, and opening of the front cover 12 is enabled.

Figure 8:
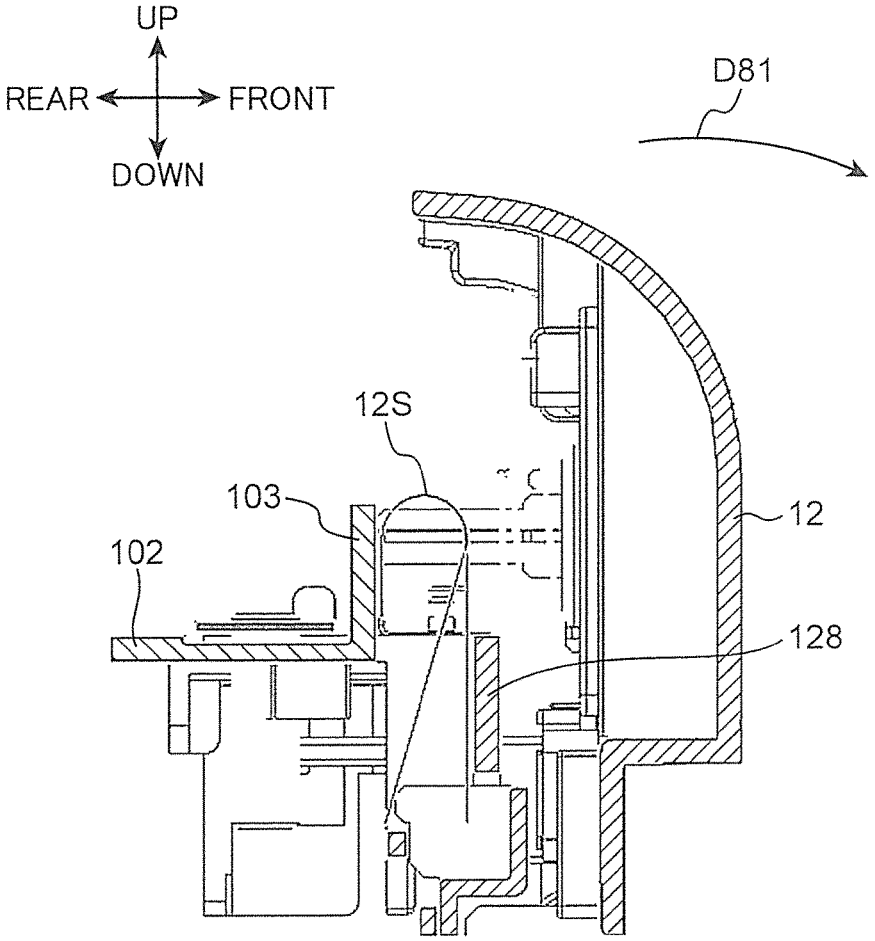
FIG. 8 is a sectional view of the vicinity of a pressing spring disposed inside the image forming apparatus according to the embodiment of the present disclosure.

FIG. 8 is a sectional view illustrating the vicinity of a pressing spring 12S disposed inside the image forming apparatus 1 according to the embodiment. The body housing 10 includes the pressing spring 12S, a housing wall portion 102, and a first engaging portion 103. Further, the front cover 12 includes a second engaging portion 128. The housing wall portion 102 is a wall portion disposed inside the body housing 10. The pressing spring 12S is a spring member disposed between the first engaging portion 103 of the housing wall portion 102, and the second engaging portion 128 of the front cover 12. When the paired locking members 127 (see FIG. 7) are respectively received in the paired front-cover locking engaging portions 100 (see FIG. 2), the pressing spring 12S is compressively deformed between the first engaging portion 103 and the second engaging portion 128. When the lock release button 121 is pressed, and the paired locking members 127 are retracted from the paired front-cover locking engaging portions 100, the pressing spring 12S urges the front cover 12 in the direction of the arrow D81 in FIG. 8 to open the front cover 12 up to a predetermined standby position. In the embodiment, the standby position corresponds to a position where the front surface portion of the front cover 12 is inclined by 1.0 degree with respect to a vertical direction. Therefore, when a user presses the lock release button 121, the front cover 12 is set to a state that the front cover 12 is slightly opened forwardly. Thus, a user is allowed to open the front cover 12.

The lid top cover 13 is a cover for defining a front end of the upper surface portion of the body housing 10. As illustrated in FIG. 1 and FIG. 2, the lid top cover 13 constitutes a part of the sheet discharge portion 14. Further, the lid top cover 13 is connected to an upper end of the front cover 12. The lid top cover 13 includes a pair of arms 130 (a second pivot portion). Each of the paired arms 130 is an arc-shaped member disposed on a rear end of the lid top cover 13. The paired arms 130 are respectively pivotally supported on the body housing 10. When the lid top cover 13 is opened upwardly around the paired arms 130 as a pivot, a part of the inner space 10A is exposed to the outside of the body housing 10 (see FIG. 2).

Further, the lid top cover 13 includes a pair of locking pieces 131. The paired locking pieces 131 are projecting pieces respectively projecting downwardly from a front end of the lid top cover 13, specifically from both ends of the lid top cover 13 in a left-right direction. Each of the locking pieces 131 is engageable in a corresponding one of top-cover locking engaging portions 101 (see FIG. 2) of the housing side unit 10S to be described later.

Figure 13:
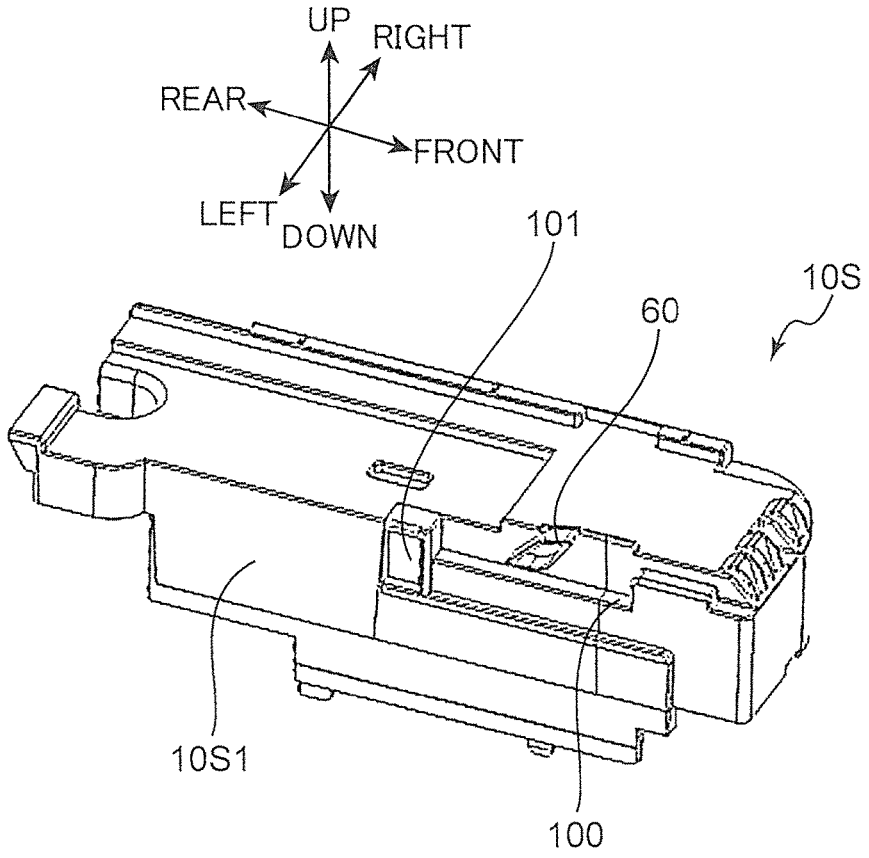
FIG. 13 is a perspective view of an inner wall portion in the embodiment of the present disclosure.

Further, the body housing 10 includes the housing side unit 10S (an inner wall portion) (see FIG. 2 and FIG. 13). The housing side unit 10S is a unit constituting a part of the body housing 10, and is disposed to face the front cover 12 and the lid top cover 13. In FIG. 1, the housing side unit 10S is covered by the front cover 12 and the lid top cover 13. Further, a member equivalent to the housing side unit 10S illustrated in FIG. 2 is disposed on the left side of the body housing 10.

The body housing 10 further includes an interlocking mechanism 5 (see FIG. 4). The interlocking mechanism 5 has a function of lifting the front end of the lid top cover 13 by a predetermined distance in association with a user's operation of opening the front cover 12 from a state that the lid top cover 13 and the front cover 12 are closed. In the embodiment, the interlocking mechanism 5 lifts the front end of the lid top cover 13 by a predetermined distance in association with an operation of opening the front cover 12 further upwardly than the standby position. Further, the interlocking mechanism 5 has a function of holding a closed state of the lid top cover 13 for a period until the front cover 12 is closed by a user from a state that the lid top cover 13 is closed and the front cover 12 is opened.

Figure 9:
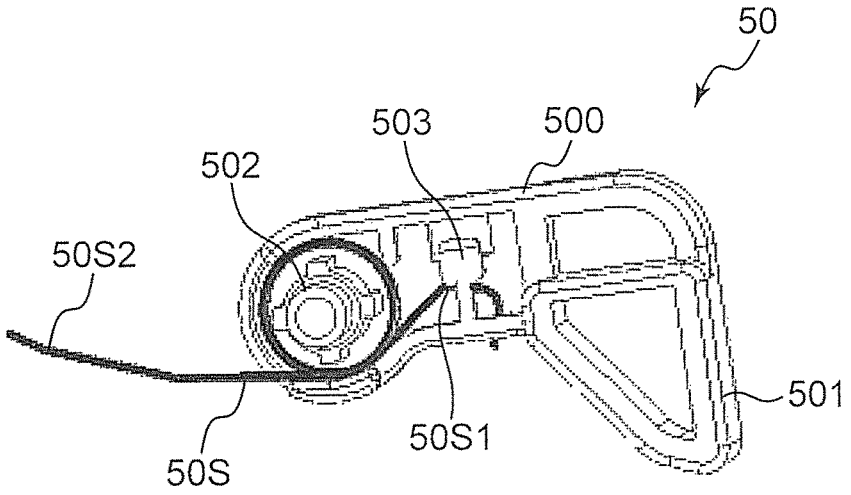
FIG. 9 is a perspective view of a lifting lever of the image forming apparatus according to the embodiment of the present disclosure.
Figure 10:
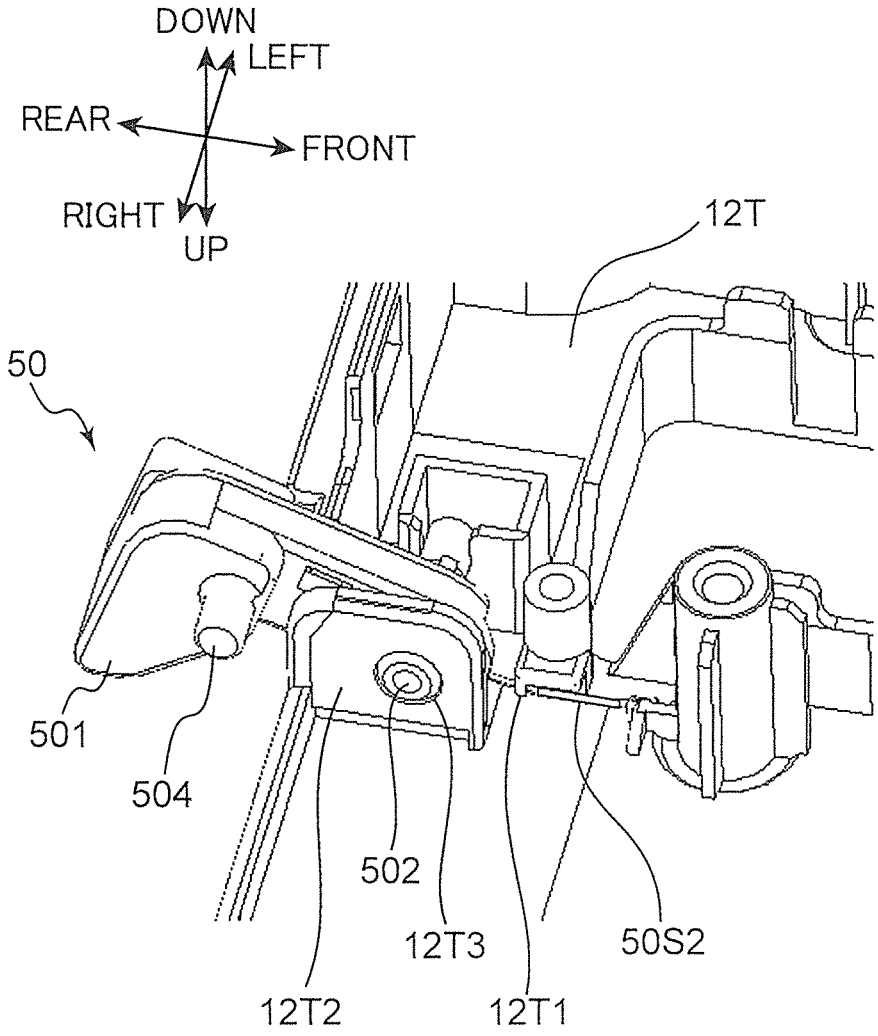
FIG. 10 is a perspective view illustrating a state that the lifting lever illustrated in FIG. 9 has been mounted on the front cover.
Figure 11:
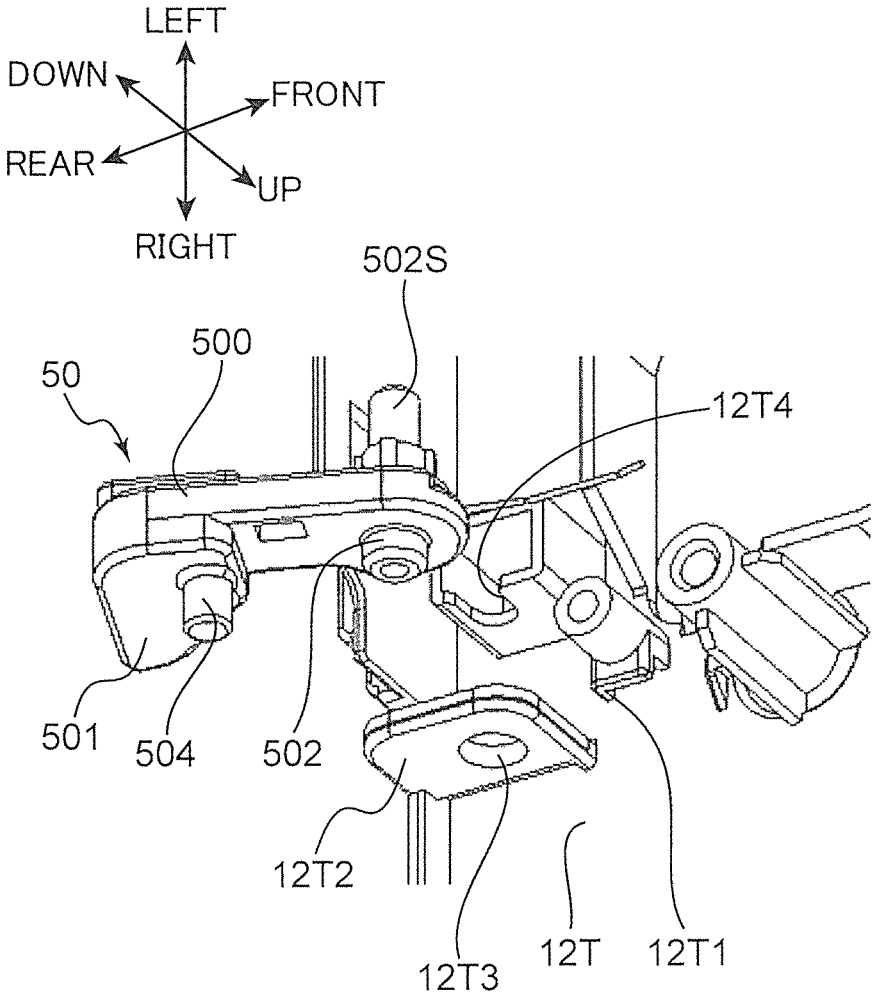
FIG. 11 is a perspective view illustrating a state that the lifting lever illustrated in FIG. 9 is how mounted on the front cover.
Figure 12:
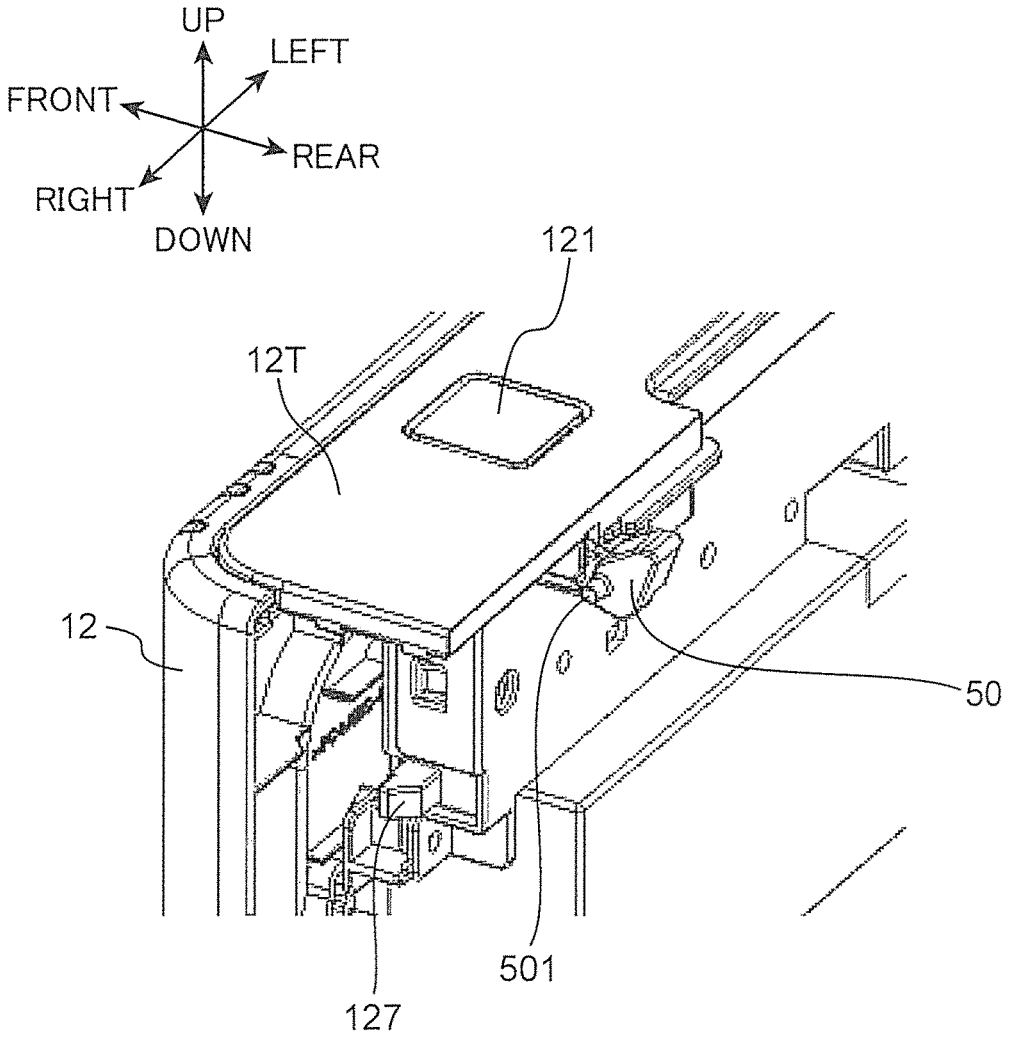
FIG. 12 is a perspective view illustrating a state that the lifting lever and a locking member project from the front cover of the image forming apparatus according to the embodiment of the present disclosure.

The interlocking mechanism 5 includes a hole portion 12T3 (a shaft support portion), a lifting lever 50, a lever urging spring 50S, and a guide portion 60. FIG. 9 is a perspective view of the lifting lever 50 of the image forming apparatus 1 according to the embodiment. FIG. 10 is a perspective view illustrating a state that the lifting lever 50 illustrated in FIG. 9 has been mounted on the front cover 12. FIG. 11 is a perspective view illustrating a state that the lifting lever 50 illustrated in FIG. 9 is how mounted on the front cover 12. FIG. 12 is a perspective view illustrating a state that the lifting lever 50 and the locking members 127 are projected from the front cover 12 of the image forming apparatus 1 according to the embodiment. Further, FIG. 13 is a perspective view of the housing side unit 10S in the embodiment.

Referring to FIG. 9 and FIG. 10, the lifting lever 50 is a lever member pivotally supported on the front cover 12. The lifting lever 50 has a function of lifting the front end of the lid top cover 13 accompanied by an operation of opening the front cover 12. The lifting lever 50 includes a lever body 500, a lifting portion 501 (a distal end), a shaft portion 502, a spring locking portion 503, and an engaging projection 504 (see FIG. 10).

The lever body 500 is a body portion of the lifting lever 50, and is constituted by an elongated plate-shaped member. The lifting portion 501 is a substantially triangular area formed on one end of the lever body 500. The lifting portion 501 has a function of coming into contact with the lid top cover 13. In the embodiment, the lifting portion 501 of the lifting lever 50 lifts the front end of the lid top cover 13 by a predetermined distance in association with an operation of opening the front cover 12. The shaft portion 502 is a columnar-shaped projection disposed on the side opposite to the lifting portion 501 of the lever body 500. The shaft portion 502 projects from both lateral surfaces of the lever body 500 in such a manner that the shaft portion 502 passes through the lever body 500. The spring locking portion 503 is a projecting piece formed on the lever body 500 between the lifting portion 501 and the shaft portion 502. The spring locking portion 503 has a function of locking one end portion 50S1 of the lever urging spring 50S. The engaging projection 504 is a columnar-shaped projection projecting from a lateral surface of the lever body 500 on the side opposite to the spring locking portion 503. When the lifting lever 50 is mounted on the front cover 12, the engaging projection 504 is projected toward the housing side unit 10S, and is allowed to come into contact with the upper guide surface 60A and the lower guide surface 60B of the guide portion 60 to be described later.

The lever urging spring 50S has a function of urging the lifting lever 50 around the hole portion 12T3 in such a manner that the lifting portion 501 of the lifting lever 50 is moved downwardly away from the front end of the lid top cover 13. The lever urging spring 50S includes the one end portion 50S1 and the other end portion 50S2 (see FIG. 9). The one end portion 50S1 is locked by the spring locking portion 503 (see FIG. 9). The other end portion 50S2 is locked by a top-plate locking portion 12T1 to be described later (see FIG. 10). In the embodiment, the lifting lever 50 and the lever urging spring 50S constitute an assembly (a sub assembly).

Further, referring to FIG. 10 and FIG. 11, the front cover 12 includes the top-plate locking portion 12T1, a projecting piece 12T2, the hole portion 12T3, and a groove portion 12T4 (see FIG. 11). The top-plate locking portion 12T1 is disposed on a lower surface of the front-cover top plate 12T. As illustrated in FIG. 10, the top-plate locking portion 12T1 has a function of fixing a part of the lever urging spring 50S. The projecting piece 12T2 is a plate-shaped projecting piece projecting from the lower surface of the front-cover top plate 12T with a gap from the top-plate locking portion 12T1. The hole portion 12T3 is opened in the projecting piece 12T2. The groove portion 12T4 is a groove formed in a substantially rectangular parallelepiped-shaped projecting portion projecting from the lower surface of the front-cover top plate 12T with a gap from the projecting piece 12T2 leftwardly.

Referring to FIG. 11, a base end portion (a right end) of the shaft portion 502 of the lifting lever 50 is received in the hole portion 12T3, and a shaft-portion distal end 502S of the shaft portion 502 is received in the groove portion 12T4. Consequently, the lifting lever 50 is pivotally supported around the hole portion 12T3 and the groove portion 12T4 (see FIG. 10), and is set in a posture extending toward the front end of the lid top cover 13 (see FIG. 4 and FIG. 12).

Referring to FIG. 13, the housing side unit 10S includes a left surface 10S1. The left surface 10S1 is a surface for defining a left lateral portion of the housing side unit 10S. The left surface 10S1 defines the inner space 10A. The front-cover locking engaging portion 100 and the top-cover locking engaging portion 101 are recess portions formed in the left surface 10S1. Further, the guide portion 60 is disposed between the front-cover locking engaging portion 100 and the top-cover locking engaging portion 101.

Figure 14:
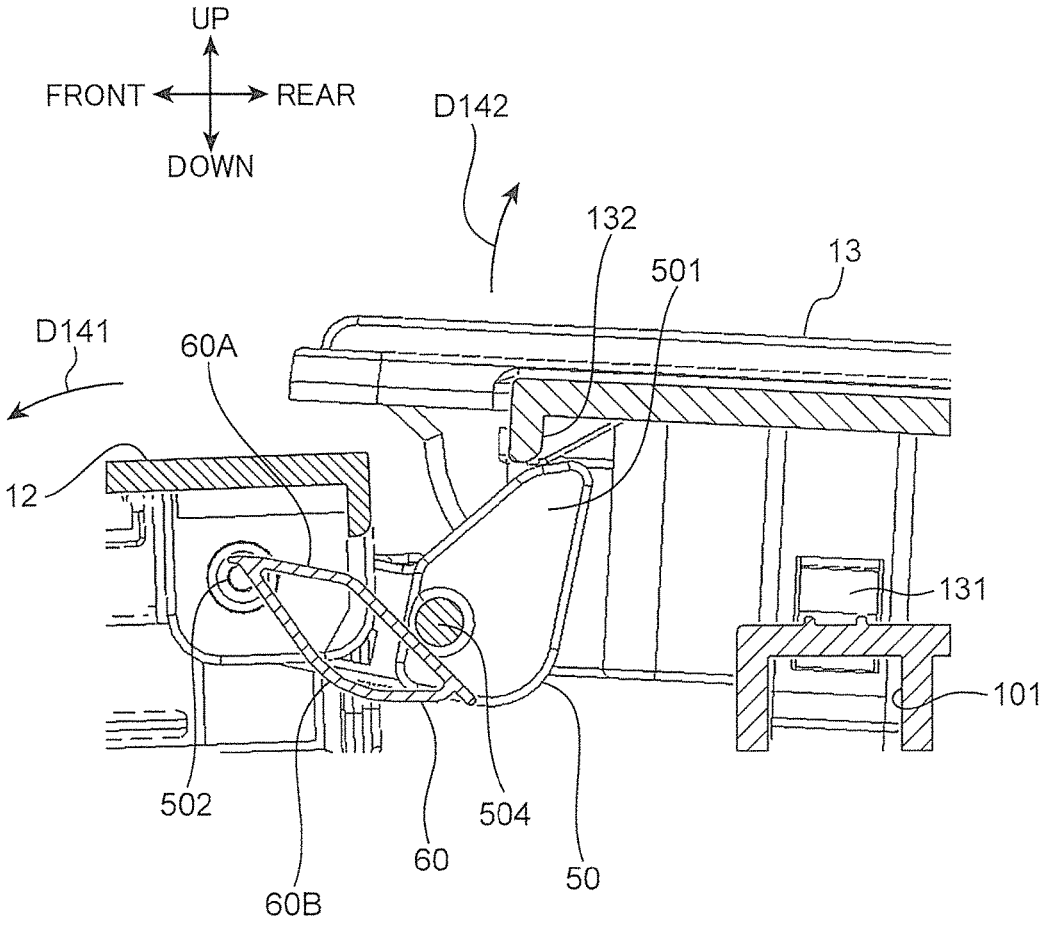
FIG. 14 is an enlarged sectional view illustrating a state that the front cover of the image forming apparatus according to the embodiment of the present disclosure is opened.
Figure 15:
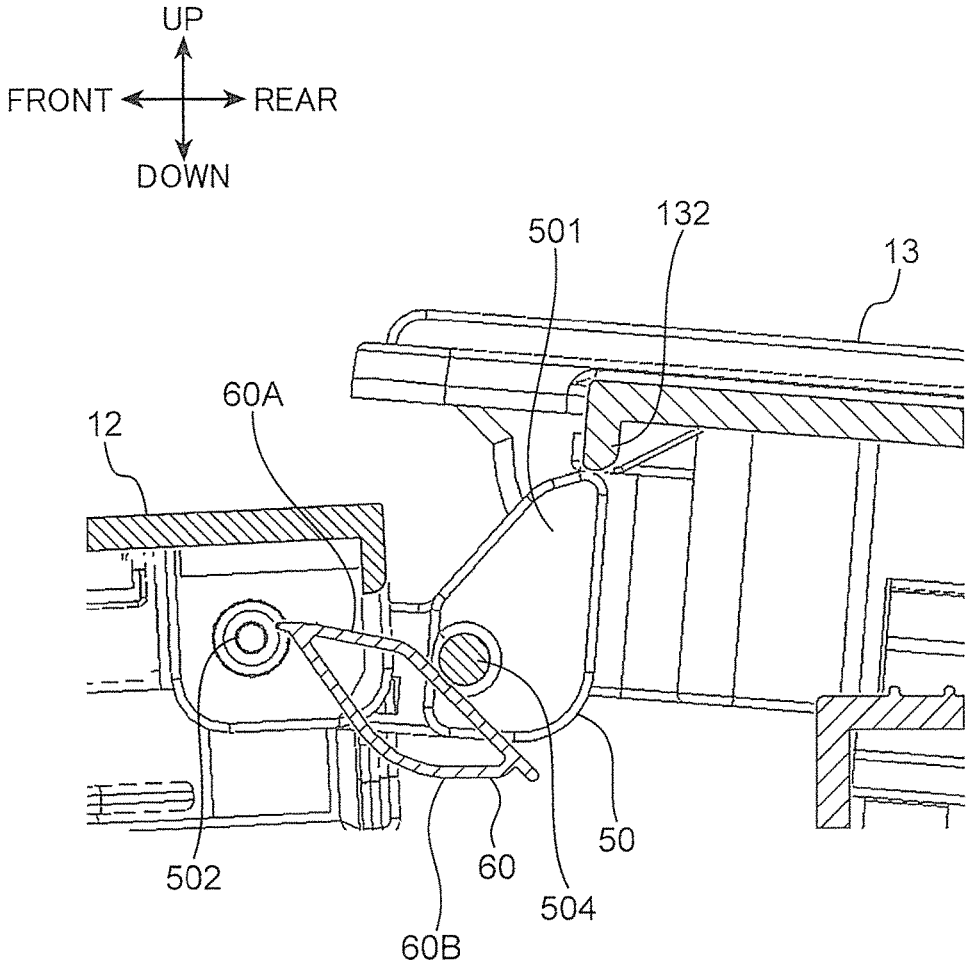
FIG. 15 is an enlarged sectional view illustrating a state that the front cover of the image forming apparatus according to the embodiment of the present disclosure is opened.
Figure 16:
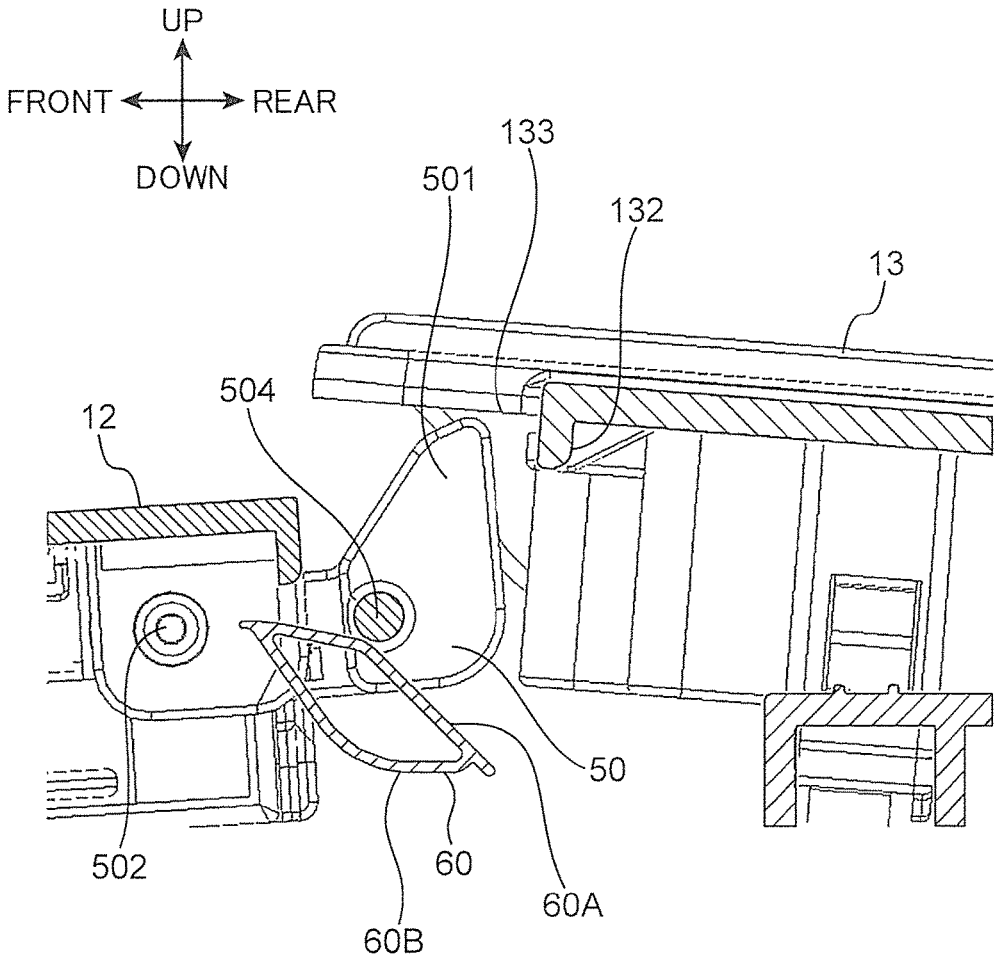
FIG. 16 is an enlarged sectional view illustrating a state that the front cover of the image forming apparatus according to the embodiment of the present disclosure is opened.

The guide portion 60 is a projecting portion projecting leftwardly from the left surface 10S1. The guide portion 60 has a predetermined width in a left-right direction. When the guide portion 60 is viewed from the left side in FIG. 13, the external appearance of the guide portion 60 has a substantially parallelogram shape. The guide portion 60 includes the upper guide surface 60A and the lower guide surface 60B (see FIG. 14). The upper guide surface 60A is constituted by an upper surface portion of the guide portion 60, and is constituted by two planes intersecting with each other, specifically, planes extending at angles different from each other, and connected to each other with respect to a predetermined ridge as a boundary. Likewise, the lower guide surface 60B is constituted by a lower surface portion of the guide portion 60, and is constituted by two planes intersecting with each other.

An unillustrated housing side unit formed on the left side of the body housing 10 also includes the front-cover locking engaging portion 100 and the top-cover locking engaging portion 101, as well as the housing side unit 10S. In the embodiment, the guide portion 60 is formed only on the right-side housing side unit 10S.

Next, functions of the interlocking mechanism 5 accompanied by an operation of opening/closing the front cover 12 are described. FIG. 14 to FIG. 17 are enlarged sectional views illustrating states that the front cover 12 of the image forming apparatus 1 according to the embodiment is opened. FIG. 14 to FIG. 17 illustrate states that the front cover 12 is gradually opened in this order.

When an operation of replacing the toner container 15 disposed inside the image forming apparatus 1 is performed as described above, for example, a user may access the inner space 10A of the body housing 10. In this case, when the user presses the lock release button 121, the paired locking members 127 are moved away from the front-cover locking engaging portions 100 of the body housing 10, respectively. Then, the front cover 12 is pivotally moved around the pivot portion 12J (see FIG. 3) up to a predetermined standby position by an urging force of the pressing spring 12S (see FIG. 8). By forward projection of the front cover 12, the user recognizes that the front cover 12 is openable, and further opens the front cover 12, while holding a holding portion 12H (see FIG. 1) formed on the front cover 12.

When the front cover 12 is set at the standby position, the locking pieces 131 (see FIG. 14) of the lid top cover 13 are still in engagement in the top-cover locking engaging portions 101. When the user starts to open the front cover 12 from the standby position, as illustrated in FIG. 14 to FIG. 17, the engaging projection 504 of the lifting lever 50 is moved along the upper guide surface 60A of the guide portion 60 in association with an operation of opening the front cover 12 (see the arrow D141 in FIG. 14). In this case, when the lifting portion 501 comes into contact with a lifted portion 132 of the lid top cover 13, the engaging projection 504 enters between the lifted portion 132 and the upper guide surface 60A (see FIG. 14), while causing elastic deformation of the lever urging spring 50S (see FIG. 9). This makes it possible to prevent that the engaging projection 504 inadvertently enters an area beneath the lower guide surface 60B.

Figure 17:
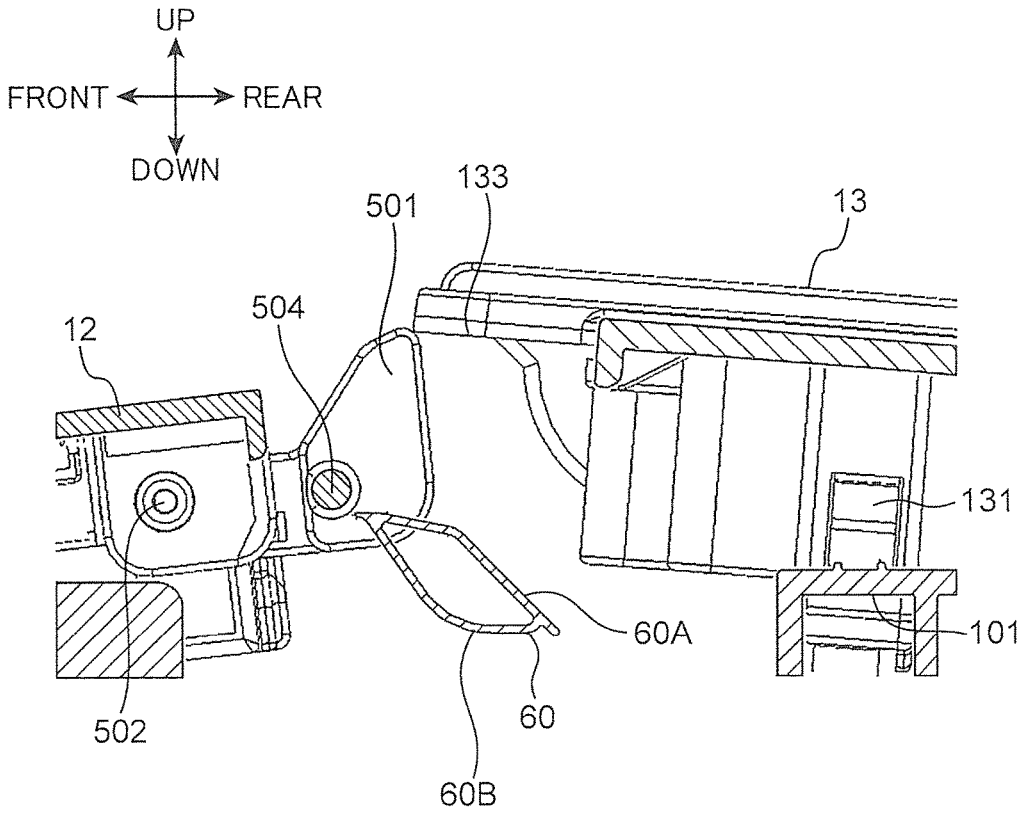
FIG. 17 is an enlarged sectional view illustrating a state that the front cover of the image forming apparatus according to the embodiment of the present disclosure is opened.

Then, the lifting portion 501 of the lifting lever 50 lifts the front end (the lifted portion 132) of the lid top cover 13 by a predetermined distance (see the arrow D142 in FIG. 14) (a pop-up function) in a state that a lower limit position of the lifting lever 50 is restricted by the upper guide portion 60A. In a state illustrated in FIG. 14, an angle (a lifting angle) formed by an upper surface portion of the lid top cover 13 and a horizontal direction is 2.9 degrees. Further, in a state illustrated in FIG. 15, an angle formed by the upper surface portion of the lid top cover 13 and the horizontal direction is 4.5 degrees. Further, in a state illustrated in FIG. 16, although the lifting portion 501 of the lifting lever 50 passes the lifted portion 132 of the lid top cover 13, the engaging projection 504 comes into contact with the upper guide portion 60A of the guide portion 60. Further, in the states of FIG. 14 to FIG. 16, since the upper guide portion 60A presses the engaging projection 504 of the lifting lever 50, the lever urging spring 50S (see FIG. 9) is elastically deformed. Further, as illustrated in FIG. 17, when the engaging projection 504 is moved away from the upper guide surface 60A, the lifting lever 50 is returned downwardly by an elastic force of the lever urging spring 50S (see FIG. 12).

When the front end of the lid top cover 13 is lifted upwardly, the locking pieces 131 are moved onto upper ends of the top-cover locking engaging portions 101. Therefore, the lid top cover 13 is held in a slightly opened state.

Figure 18:
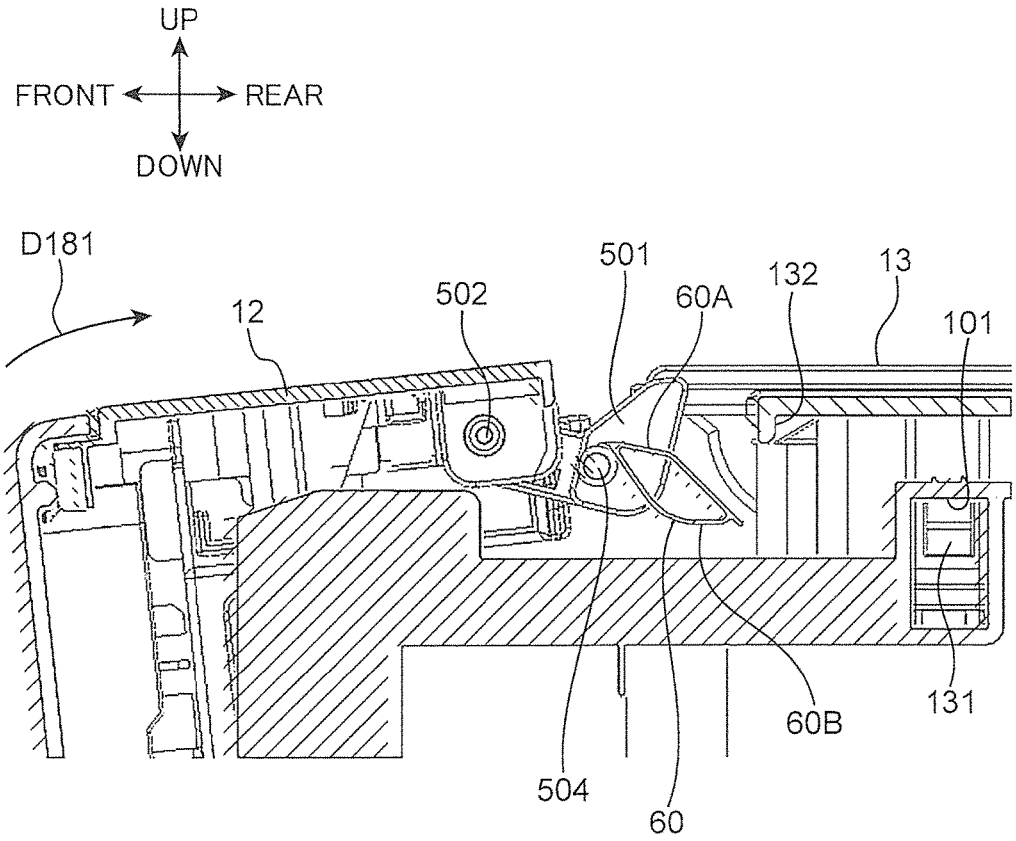
FIG. 18 is an enlarged sectional view illustrating a state that the front cover of the image forming apparatus according to the embodiment of the present disclosure is closed.
Figure 19:
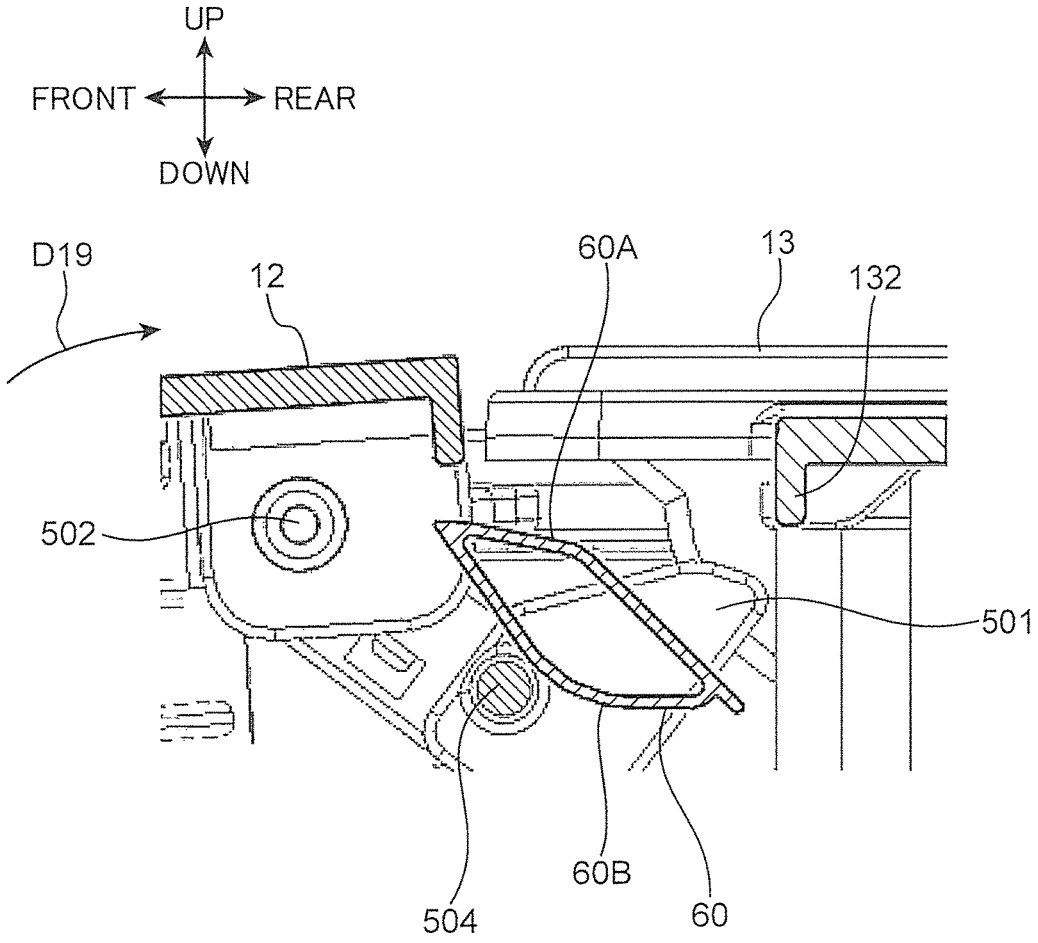
FIG. 19 is an enlarged sectional view illustrating a state that the front cover of the image forming apparatus according to the embodiment of the present disclosure is closed.
Figure 20:
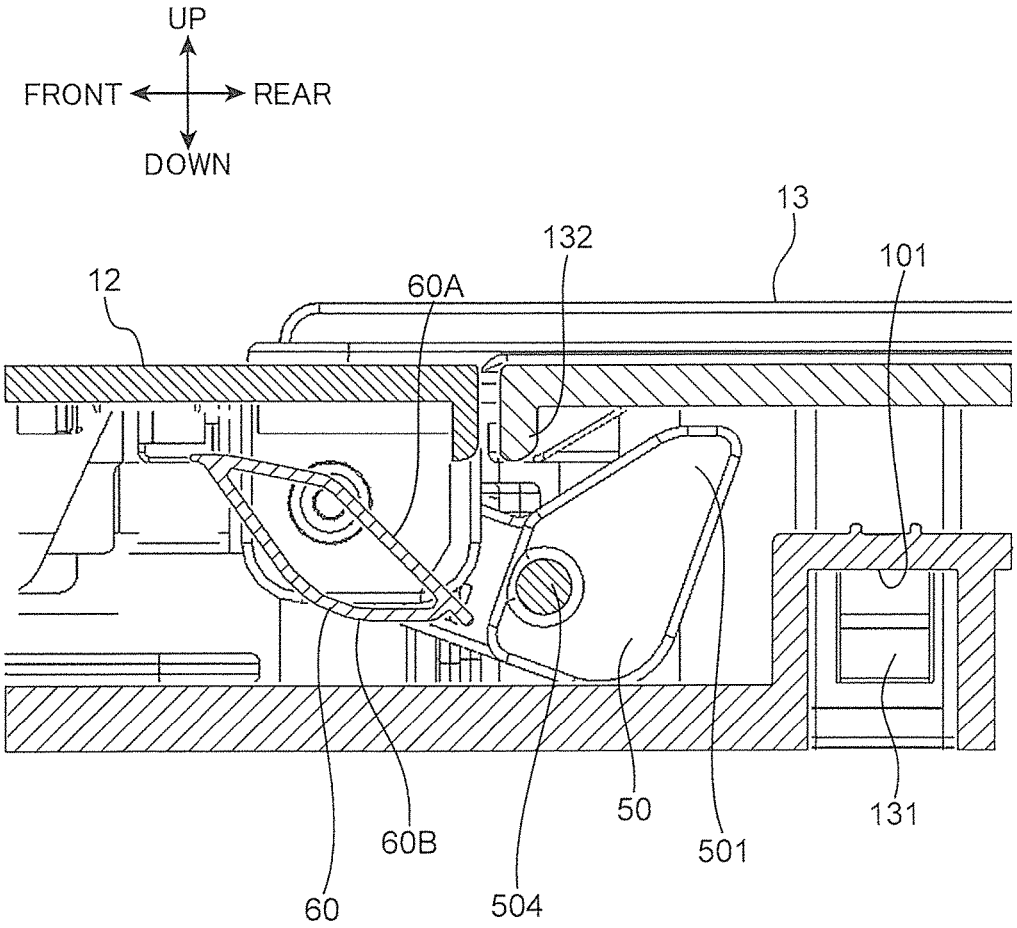
FIG. 20 is an enlarged sectional view illustrating a state that the front cover of the image forming apparatus according to the embodiment of the present disclosure is closed.

On the other hand, FIG. 18 to FIG. 20 are enlarged sectional views illustrating states that the front cover 12 of the image forming apparatus 1 according to the embodiment is closed. When a predetermined operation inside the inner space 10A (such as mounting or dismounting the toner container 15) is finished, first of all, an operator pushes the lid top cover 13 from above, whereby the lid top cover 13 is closed with respect to the body housing 10. In this case, the paired locking pieces 131 of the lid top cover 13 are engaged in the paired top-cover locking engaging portions 101 of the body housing 10. In this way, when the front cover 12 is closed from a state that the lid top cover 13 is closed and the front cover 12 is opened (see the arrow D181 in FIG. 18), as illustrated in FIG. 18, the engaging projection 504 of the lifting lever 50 is moved along the lower guide surface 60B of the guide portion 60. In this case, since the lifting lever 50 is pivotally moved downwardly around the shaft portion 502 by an urging force of the lever urging spring 50S, the engaging projection 504 is allowed to smoothly enter beneath the guide portion 60. Further, when the front cover 12 is closed (see the arrow D19 in FIG. 19), an upper limit position of the lifting lever 50 is restricted by the lower guide surface 60B, and the lifting portion 501 of the lifting lever 50 passes an area beneath the front end (the lifted portion 132) of the lid top cover 13 by a predetermined gap (see FIG. 19 and FIG. 20). Therefore, a closed state of the lid top cover 13 is held without likelihood that the lid top cover 13 is lifted by the lifting lever 50.

When the front cover 12 is completely closed, the paired locking members 127 (see FIG. 7) of the front cover 12 are engaged in the paired front-cover locking engaging portions 100 (see FIG. 2) of the body housing 10, and the front cover 12 is locked. In this case, as illustrated in FIG. 20, the lifting portion 501 of the lifting lever 50 is located at an upper position than the lifted portion 132 of the lid top cover 13. Therefore, it is possible for the lifting portion 501 to lift the lifted portion 132 when the front cover 12 is opened again.

As described above, in the embodiment, it is possible to mount or dismount a member or a unit with respect to the inner space 10A by opening the front cover 12 and the lid top cover 13. The interlocking mechanism 5 lifts the front end (the lifted portion 132) of the lid top cover 13 by a predetermined distance in association with an operation of opening the front cover 12 from a state that the lid top cover 13 and the front cover 12 are closed. This allows a user to recognize that the lid top cover 13 is openable accompanied by opening of the front cover 12. Consequently, it is possible to prevent damage or breakage of a unit or the lid top cover 13 without likelihood that a user forcibly accesses the inner space 10A, or inserts each unit into the inner space 10A in a closed state of the lid top cover 13. In the embodiment, when an angle formed by the front surface portion of the front cover 12 and a vertical direction exceeds 1.2 degrees, the lifting lever 50 lifts the front end of the lid top cover 13.

Further, the interlocking mechanism 5 holds a closed state of the lid top cover 13 during a period until the front cover 12 is closed from a state that the lid top cover 13 is closed and the front cover 12 is opened. This makes it possible to prevent that the lid top cover 13 is inadvertently lifted when the front cover 12 is closed in a state that the lid top cover 13 is closed first.

Further, in the embodiment, the front cover 12 is automatically opened up to a predetermined standby position in response to a user's operation of pressing the lock release button 121. Then, when the user further opens the front cover 12, the interlocking mechanism 5 lifts the front end of the lid top cover 13 by a predetermined distance. Therefore, the user is allowed to recognize that the lid top cover 13 is openable, since the lid top cover 13 is lifted (popped up) when the user is operating the front cover 12.

Further, in the embodiment, it is possible to lift the front end of the lid top cover 13 by a predetermined distance, accompanied by a pivotal movement of the lifting lever 50 projecting from the front cover 12. In this case, since the lifting lever 50 is pivotally movable around the shaft portion 502, it is possible to prevent application of an excessive force to the lid top cover 13.

Further, in the embodiment, the guide portion 60 includes the upper guide surface 60A and the lower guide surface 60B. Therefore, it is possible to securely lift the front end of the lid top cover 13 when the front cover 12 is opened. Further, it is possible to prevent likelihood that the lifting lever 50 lifts the front end of the lid top cover 13 when the front cover 12 is closed.

As described above, an embodiment of the present disclosure is described in detail. The present disclosure, however, is not limited to the above. The following modifications are applicable to the present disclosure.

(1) In the embodiment, the front cover 12 includes one lifting lever 50. Alternatively, a plurality of lifting levers 50 may be disposed at a certain interval in a left-right direction. Specifically, the present disclosure is achieved, as far as a front cover 12 includes at least one lifting lever 50. It should be noted that it is possible to securely lift the front end of the lid top cover 13 by a plurality of lifting levers 50.

(2) Further, in the embodiment, the lid top cover 13 is lifted accompanied by an operation of opening the front cover 12 after the front cover 12 is set to a standby position. Alternatively, it is possible to configure such that a lifting lever 50 lifts a lid top cover 13 in association with an initial operation of opening a front cover 12 in response to an operation of pressing a lock release button 121. Specifically, it is possible to open the front cover 12 and lift the lid top cover 13 simultaneously.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. An image forming apparatus, comprising:

a body housing including an inner space; and an image forming unit disposed inside the inner space and configured to form an image on a sheet, wherein the body housing includes:

a front cover for defining a front surface portion of the body housing, the front cover being configured to expose a part of the inner space to an outside of the body housing by being opened forwardly around a first pivot portion disposed on a lower end of the front cover;

a top cover for defining an upper surface portion of the body housing and connected to an upper end of the front cover, the top cover being configured to expose a part of the inner space to the outside of the body housing by being opened upwardly around a second pivot portion disposed on a rear end of the top cover; and an interlocking mechanism for lifting a front end of the top cover by a predetermined distance in association with an operation of opening the front cover from a state that the top cover and the front cover are closed, and holding a closed state of the top cover for a period until the front cover is closed from a state that the top cover is closed and the front cover is opened.

2. The image forming apparatus according to claim 1, wherein the body housing includes:

a pressing spring for urging the front cover in such a manner that the front cover is opened up to a predetermined standby position; and an inner wall portion disposed to face the front cover and the top cover, and including a locking engaging portion, the front cover includes:

a lock release button;

a locking member engagable in the locking engaging portion of the inner wall portion;

an urging member for urging the locking member in such a manner that the locking member is engaged in the locking engaging portion; and an unlocking mechanism for unlocking the locking member from the locking engaging portion in association with an operation of pressing the lock release button, the locking member is disengaged from the locking engaging portion, and the front cover is opened up to the standby position by an urging force of the pressing spring when the lock release button is pressed, and the interlocking mechanism lifts the front end of the top cover by a predetermined distance in association with an operation of opening the front cover further than the standby position.

3. The image forming apparatus according to claim 1, wherein the interlocking mechanism includes:

a shaft support portion formed in the front cover; and at least one lifting lever pivotally supported around the shaft support portion, and extending toward the front end of the top cover, and a distal end of the at least one lifting lever lifts the front end of the top cover by a predetermined distance in association with an operation of opening the front cover.

4. The image forming apparatus according to claim 3, wherein the interlocking mechanism includes:

a lever urging spring for urging the at least one lifting lever around the shaft support portion in such a manner that the distal end of the at least one lifting lever is moved away from the front end of the top cover; and a guide portion fixed to the inner wall portion, and including an upper guide surface and a lower guide surface, the at least one lifting lever has an engaging projection projecting toward the inner wall portion, and configured to come into contact with the upper guide surface and the lower guide surface, the engaging projection of the at least one lifting lever is moved along the upper guide surface of the guide portion accompanied by elastic deformation of the lever urging spring in association with an operation of opening the front cover, whereby the distal end of the at least one lifting lever lifts the front end of the top cover by a predetermined distance in a state that a lower limit position of the at least one lifting lever is restricted, and when the front cover is closed from a state that the top cover is closed and the front cover is opened, the engaging projection of the at least one lifting lever urged by the lever urging spring is moved along the lower guide surface of the guide portion, whereby an upper limit position of the at least one lifting lever is restricted, and a closed state of the top cover is held by passing of the distal end of the at least one lifting lever an area beneath the front end of the top cover by a predetermined gap.

5. The image forming apparatus according to claim 4, wherein the at least one lifting lever includes a plurality of the lifting levers.

* * * * *